US010680346B2

(12) United States Patent
Zimmerman et al.

(10) Patent No.: US 10,680,346 B2
(45) Date of Patent: Jun. 9, 2020

(54) ANTENNA SYSTEM WITH FREQUENCY DEPENDENT POWER DISTRIBUTION TO RADIATING ELEMENTS

(71) Applicant: CommScope Technologies LLC, Hickory, NC (US)

(72) Inventors: Martin Lee Zimmerman, Chicago, IL (US); Jonathan C. Veihl, New Lenox, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/090,513

(22) PCT Filed: Feb. 17, 2017

(86) PCT No.: PCT/US2017/018352
§ 371 (c)(1),
(2) Date: Oct. 1, 2018

(87) PCT Pub. No.: WO2017/176372
PCT Pub. Date: Oct. 12, 2017

(65) Prior Publication Data

US 2019/0115672 A1 Apr. 18, 2019

Related U.S. Application Data

(60) Provisional application No. 62/319,111, filed on Apr. 6, 2016.

(51) Int. Cl.

| | |
|---|---|
| ***H01Q 1/24*** | (2006.01) |
| ***H01Q 21/08*** | (2006.01) |
| ***H01Q 1/42*** | (2006.01) |
| ***H01Q 3/40*** | (2006.01) |
| ***H01Q 15/14*** | (2006.01) |
| ***H01Q 3/30*** | (2006.01) |

(52) U.S. Cl.
CPC ..... *H01Q 21/08* (2013.01); *H01Q 1/246* (2013.01); *H01Q 1/42* (2013.01); *H01Q 3/30* (2013.01); *H01Q 3/40* (2013.01); *H01Q 15/14* (2013.01)

(58) Field of Classification Search
CPC ..... H01Q 21/08; H01Q 1/246; H01Q 1/42; H01Q 3/40; H01Q 3/30; H01Q 15/14
See application file for complete search history.

(56) References Cited

U.S. PATENT DOCUMENTS 5,422,649 A * 6/1995 Huang ..... H01Q 21/0075 343/700 MS
5,517,687 A 5/1996 Niehenke
(Continued)

OTHER PUBLICATIONS

PCT International Preliminary Report on Patentability, dated Oct. 18, 2018 for corresponding PCT International Application No. PCT/US2017/018352 (9 pages).
(Continued)

*Primary Examiner* — Jessica Han
*Assistant Examiner* — Awat M Salih
(74) *Attorney, Agent, or Firm* — Myers Bigel, P.A.

(57) ABSTRACT

An antenna includes a frequency dependent divider circuit configured to receive an input signal and generate an output signal, the output signal having a power level based on a frequency of the input signal and a radiating element that is responsive to the first output signal.

16 Claims, 6 Drawing Sheets

(56) References Cited

U.S. PATENT DOCUMENTS

| | | | | |
|---|---|---|---|---|
| 5,596,325 | A | 1/1997 | Maas | |
| 2002/0153967 | A1 | 10/2002 | Nakada | |
| 2010/0103043 | A1 | 4/2010 | Milano | |
| 2012/0319906 | A1* | 12/2012 | Hikino ..... | H01Q 1/243 343/700 MS |
| 2016/0013563 | A1 | 1/2016 | Timofeev | |
| 2016/0043780 | A1 | 2/2016 | Chin | |

OTHER PUBLICATIONS

PCT Written Opinion dated May 31, 2017 for corresponding PCT International Application No. PCT/US2017/018352 (7 pages).
PCT International Search Report dated May 31, 2017 for corresponding PCT International Application No. PCT/US2017/018352 (5 pages).
Extended European Search Report issued for corresponding European Application No. 17779475.7, dated Nov. 13, 2019 (8 pages).
Chinese Office Action corresponding to CN 201780030320.3, dated Apr. 3, 2020 (21 pages including English translation).

* cited by examiner

| Ø | A | B |
|---|---|---|
| 0° | 1/2 | 1/2 |
| 90° | 1 | 0 |
| -90° | 0 | 1 |

ANTENNA SYSTEM WITH FREQUENCY DEPENDENT POWER DISTRIBUTION TO RADIATING ELEMENTS

CROSS-REFERENCE TO RELATED APPLICATIONS

This application is a 35 U.S.C. § 371 national stage application of PCT Application Serial No. PCT/US2017/018352, filed on Feb. 17, 2017, which itself claims priority to U.S. Provisional Patent Application Ser. No. 62/319,111, filed Apr. 6, 2016, the entire contents of the applications are incorporated by reference herein as if set forth in their entireties. The above-referenced PCT Application was published in the English language as International Publication No. WO 2017/0176372 A1 on Oct. 12, 2017.

FIELD OF THE INVENTION

The present disclosure relates generally to radio communications and, more particularly, to multi-beam antennas used in cellular communications systems.

BACKGROUND

Wireless base stations are well known in the art and typically include, among other things, baseband equipment, radios and antennas. The antennas are often mounted at the top of a tower or other elevated structure, such as a pole, a rooftop, water towers or the like. Typically, multiple antennas are mounted on the tower, and a separate baseband unit and radio are connected to each antenna. Each antenna provides cellular service to a defined coverage area or "sector."

FIG. 1 is a simplified, schematic diagram that illustrates a conventional cellular base station 10. As shown in FIG. 1, the cellular base station 10 includes an antenna tower 30 and an equipment enclosure 20 that is located at the base of the antenna tower 30. A plurality of baseband units 22 and radios 24 are located within the equipment enclosure 20. Each baseband unit 22 is connected to a respective one of the radios 24 and is also in communication with a backhaul communications system 44. Three sectorized antennas 32 (labelled antennas 32-1, 32-2, 32-3) are located at the top of the antenna tower 30. Three coaxial cables 34 (which are bundled together in FIG. 1 to appear as a single cable) connect the radios 24 to the respective antennas 32. Each end of each coaxial cable 34 may be connected to a duplexer (not shown) so that both the transmit and receive signals for each radio 24 may be carried on a single coaxial cable 34. In some implementations the radios 24 are located at the top of the tower 30 instead of in the equipment enclosure 20 to reduce signal transmission losses.

Cellular base stations typically use directional antennas 32 such as phased array antennas to provide increased antenna gain throughout a defined coverage area. A typical phased array antenna 32 may be implemented as a planar array of radiating elements mounted on a panel, with perhaps ten radiating elements per panel. Typically, each radiating element is used to (1) transmit radio frequency ("RF") signals that are received from a transmit port of an associated radio 24 and (2) receive RF signals from mobile users and feed such received signals to the receive port of the associated radio 24. Duplexers are typically used to connect the radio 24 to each respective radiating element of the antenna 32. A "duplexer" refers to a well-known type of three-port filter assembly that is used to connect both the transmit and receive ports of a radio 24 to an antenna 32 or to a radiating element of multi-element antenna 32. Duplexers are used to isolate the RF transmission paths to the transmit and receive ports of the radio 24 from each other while allowing both RF transmission paths access to the radiating elements of the antenna 32, and may accomplish this even though the transmit and receive frequency bands may be closely spaced together.

To transmit RF signals to, and receive RF signals from, a defined coverage area, each directional antenna 32 is typically mounted to face in a specific direction (referred to as "azimuth") relative to a reference such as true north, to be inclined at a specific downward angle with respect to the horizontal in the plane of the azimuth (referred to as "elevation" or "tilt"), and to be vertically aligned with respect to the horizontal (referred to as "roll").

FIG. 2A is a perspective view of a lensed multi-beam base station antenna 200 that can be used to implement the directional antennas 32 of FIG. 1. FIG. 2B is a cross-sectional view of the lensed multi-beam base station antenna 200. The lensed multi-beam base station antenna 200 is described in detail in U.S. Patent Publication No. 2015/0091767, the disclosure of which is hereby incorporated herein by reference.

Referring to FIGS. 2A and 2B, the multi-beam base station antenna 200 includes one or more linear arrays of radiating elements 210A, 210B, and 210C (referred to herein collectively using reference numeral 210). These linear arrays of radiating elements 210 are also referred to as "linear arrays" or "arrays" herein. The antenna 200 further includes an RF lens 230. Each linear array 210 may have approximately the same length as the lens 230. The multi-beam base station antenna 200 may also include one or more of a secondary lens 240 (see FIG. 2B), a reflector 250, a radome 260, end caps 270, a tray 280 (see FIG. 2B) and input/output ports 290. In the description that follows, the azimuth plane is perpendicular to the longitudinal axis of the RF lens 230, and the elevation plane is parallel to the longitudinal axis of the RF lens 230.

The RF lens 230 is used to focus the radiation coverage pattern or "beam" of the linear arrays 210 in the azimuth direction. For example, the RF lens 230 may shrink the 3 dB beam widths of the beams (labeled BEAM1, BEAM2 and BEAM 3 in FIG. 2B) output by each linear array 210 from about 65° to about 23° in the azimuth plane. While the antenna 200 includes three linear arrays 210, different numbers of linear arrays 210 may be used.

Each linear array 210 includes a plurality of radiating elements 212. Each radiating element 212 may comprise, for example, a dipole, a patch or any other appropriate radiating element. Each radiating element 212 may be implemented as a pair of cross-polarized radiating elements, where one radiating element of the pair radiates RF energy with a +45° polarization and the other radiating element of the pair radiates RF energy with a −45° polarization.

The RF lens 230 narrows the half power beam width ("HPBW") of each of the linear arrays 210 while increasing the gain of the beam by, for example, about 4-5 dB for the 3-beam multi-beam antenna 200 depicted in FIGS. 2A and 2B. All three linear arrays 210 share the same RF lens 230, and, thus, each linear array 210 has its HPBW altered in the same manner. The longitudinal axes of the linear arrays 210 of radiating elements 212 can be parallel with the longitudinal axis of the lens 230. In other embodiments, the axis of the linear arrays 210 can be slightly tilted (2-10°) to the axis of the lens 230 (for example, for better return loss or port-to-port isolation tuning).

The multi-beam base station antenna 200 may be used to increase system capacity. For example, a conventional 65° azimuth HPBW antenna could be replaced with the multi-beam base station antenna 200 as described above. This would increase the traffic handling capacity for the base station 10, as each beam would have 4-5 dB higher gain and hence could support higher data rates at the same quality of service. In another example, the multi-beam base station antenna 200 may be used to reduce antenna count at a tower or other mounting location. The three beams (BEAM 1, BEAM 2, BEAM 3) generated by the antenna 200 are shown schematically in FIG. 2B. The azimuth angle for each beam may be approximately perpendicular to the reflector 250 for each of the linear arrays 210. In the depicted embodiment the −10 dB beam width for each of the three beams is approximately 40° and the center of each beam is pointed at azimuth angles of −40°, 0°, and 40°, respectively. Thus, the three beams together provide 120° coverage.

The RF lens 230 may be formed of a dielectric lens material 232. The RF lens 230 may include a shell, such as a hollow, lightweight structure that holds the dielectric material 232. The dielectric lens material 232 focuses the RF energy that radiates from, and is received by, the linear arrays 210.

SUMMARY

In some embodiments of the inventive concept, an antenna comprises a frequency dependent divider circuit configured to receive an input signal and generate an output signal, the output signal having a power level based on a frequency of the input signal and a radiating element that is responsive to the first output signal.

In other embodiments, the frequency dependent divider circuit comprises a power divider that is configured to generate a first divided output signal and a second divided output signal responsive to the input signal, a delay line that is configured to generate a phase delayed output signal responsive to the second divided output signal, the phase delayed output signal having a phase delay based on a frequency of the second divided output signal, and a directional coupler that is configured to generate the output signal responsive to the phase delayed output signal and the first divided output signal.

In still other embodiments, the delay line comprises a transmission line configured to generate the phase delay directly proportional to the frequency of the second divided output signal.

In still other embodiments, the delay line comprises a transmission line coupled to a Shiffman phase shifter. The Shiffman phase shifter is configured to substantially maintain the phase delay independent of frequency.

In still other embodiments, the delay line comprises an inductive portion and a capacitive portion.

In still other embodiments, the antenna further comprises a stub circuit configured to generate first and second coupler input signals responsive to the phase delayed output signal and the first divided output signal. The directional coupler is configured to generate the output signal responsive to the first and second coupler signals.

In still other embodiments, the stub circuit comprises a pair of quarter-wave shorted lines.

In still other embodiments, the stub circuit comprises a pair of half-wave open ended lines.

In still other embodiments, an input impedance of the stub circuit is capacitive.

In still other embodiments, an input impedance of the stub circuit is inductive.

In still other embodiments, the directional coupler is a 90° hybrid branch-line coupler having an operational bandwidth of approximately 690 MHz-2700 MHz.

In still other embodiments, the power divider is a 3 dB multi-section Wilkinson power divider.

In still other embodiments, the radiating element comprises a linear array of radiating elements.

In still other embodiments, the output signal comprises a plurality of output signals associated with the linear array of radiating elements, respectively, and the frequency dependent divider circuit is further configured to generate the plurality of output signals so as to have increasingly tapered power levels at each end of the linear array.

In still other embodiments, the radiating element comprises one of a plurality of radiating elements.

In still other embodiments, the frequency dependent divider circuit is further configured to adjust a taper of an aperture of the output signal based on the frequency of the input signal.

In still other embodiments, the frequency dependent divider circuit is further configured to adjust an insertion loss of the antenna based on the frequency of the input signal.

It is noted that aspects described with respect to one embodiment may be incorporated in different embodiments although not specifically described relative thereto. That is, all embodiments and/or features of any embodiments can be combined in any way and/or combination. Moreover, other apparatus, methods, systems, and/or articles of manufacture according to embodiments of the inventive subject matter will be or become apparent to one with skill in the art upon review of the following drawings and detailed description. It is intended that all such additional apparatus, systems, methods, and/or articles of manufacture be included within this description, be within the scope of the present inventive subject matter, and be protected by the accompanying claims. It is further intended that all embodiments disclosed herein can be implemented separately or combined in any way and/or combination.

BRIEF DESCRIPTION OF THE DRAWINGS

Other features of embodiments will be more readily understood from the following detailed description of specific embodiments thereof when read in conjunction with the accompanying drawings, in which.

DETAILED DESCRIPTION

In the following detailed description, numerous specific details are set forth to provide a thorough understanding of embodiments of the present disclosure. However, it will be understood by those skilled in the art that the present invention may be practiced without these specific details. In some instances, well-known methods, procedures, components and circuits have not been described in detail so as not to obscure the present disclosure. It is intended that all embodiments disclosed herein can be implemented separately or combined in any way and/or combination. Aspects described with respect to one embodiment may be incorporated in different embodiments although not specifically described relative thereto. That is, all embodiments and/or features of any embodiments can be combined in any way and/or combination.

Some governmental jurisdictions place limits on antenna gain at one or more frequencies. For example, a governmental jurisdiction may define a power threshold for one or more frequency ranges and service providers may be required to ensure that transmission power is at or below this threshold. Some embodiments of the inventive concept stem from a realization that a frequency dependent power divider circuit may be used between, for example, a beam forming network and a radiating element to reduce the power directed to that radiating element based on signal frequency. The radiating element may represent an entire antenna, a linear array of radiating elements that comprises part of an antenna, and/or a single radiating element that is part of a larger array of radiating elements in accordance with various embodiments of the inventive concept. The frequency dependent power divider circuit may reduce the power directed to the radiating element at other frequencies than those for which a power reduction is desired. A stub circuit may be used to reduce the amount of power diverted away from the radiating element at frequencies for which a lesser power reduction is desired.

Figure 1:
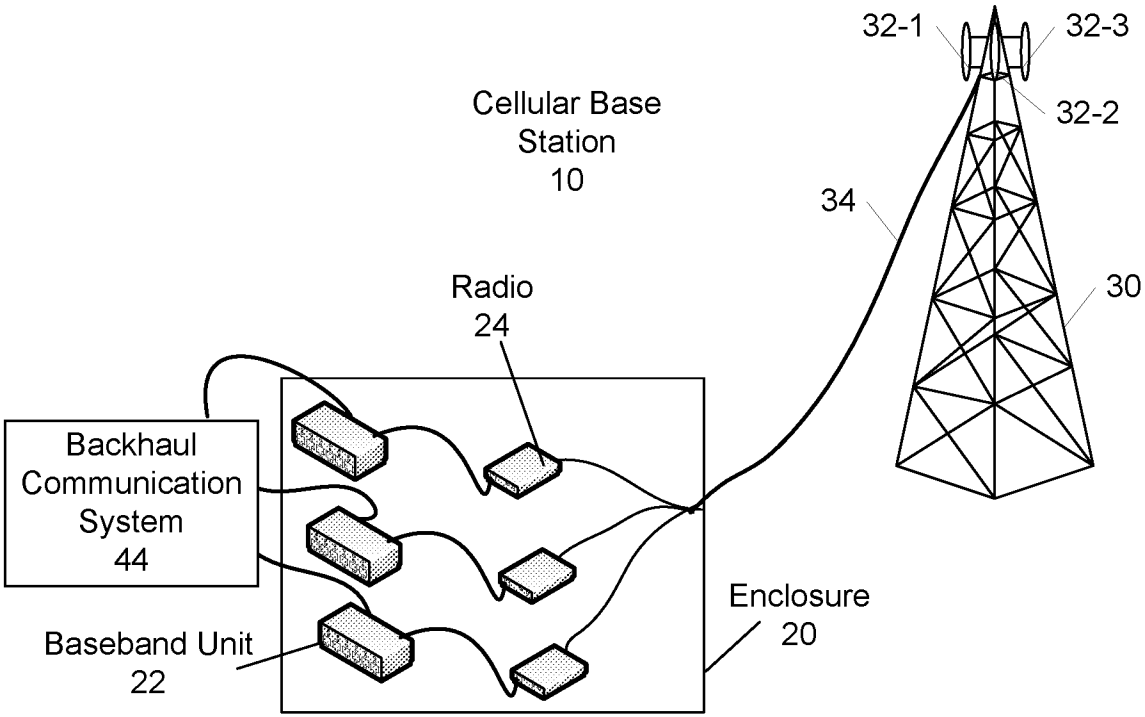
FIG. 1 (Prior Art)
FIG. 1 is a simplified, schematic diagram that illustrates a conventional cellular base station.
Figure 2A:
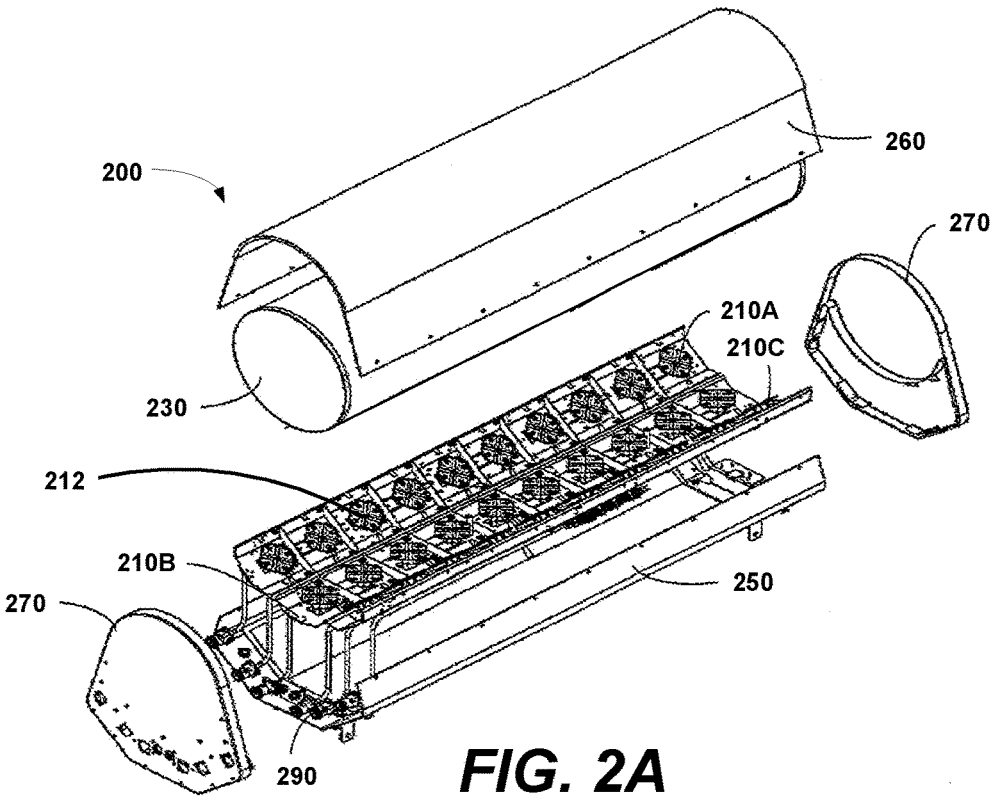
FIG. 2A (Prior Art)
FIG. 2A is a perspective view of a lensed multi-beam base station antenna that can be used to implement the directional antenna of FIG. 1.
Figure 2B:
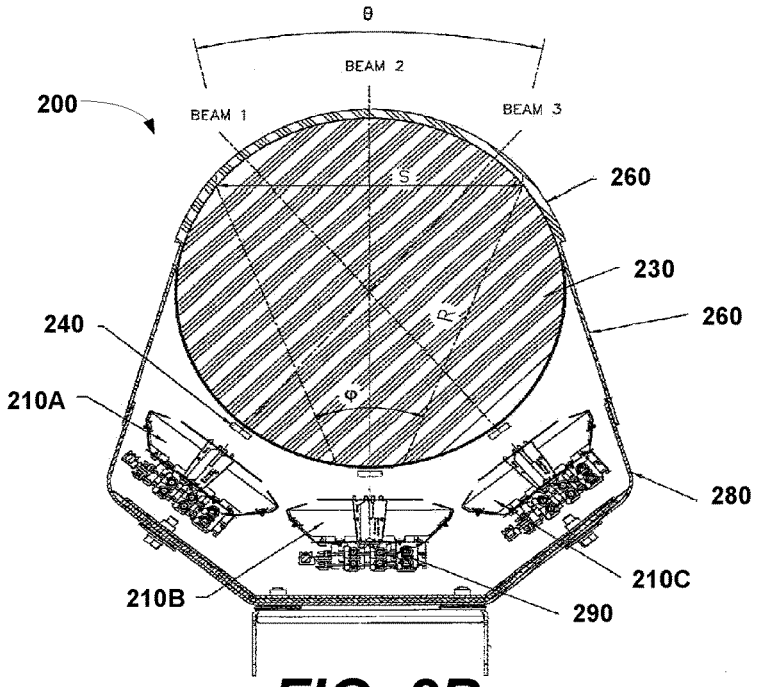
FIG. 2B (Prior Art)
FIG. 2B is a cross-sectional view of the lensed multi-beam base station antenna of FIG. 2A.
Figures 3, 4:
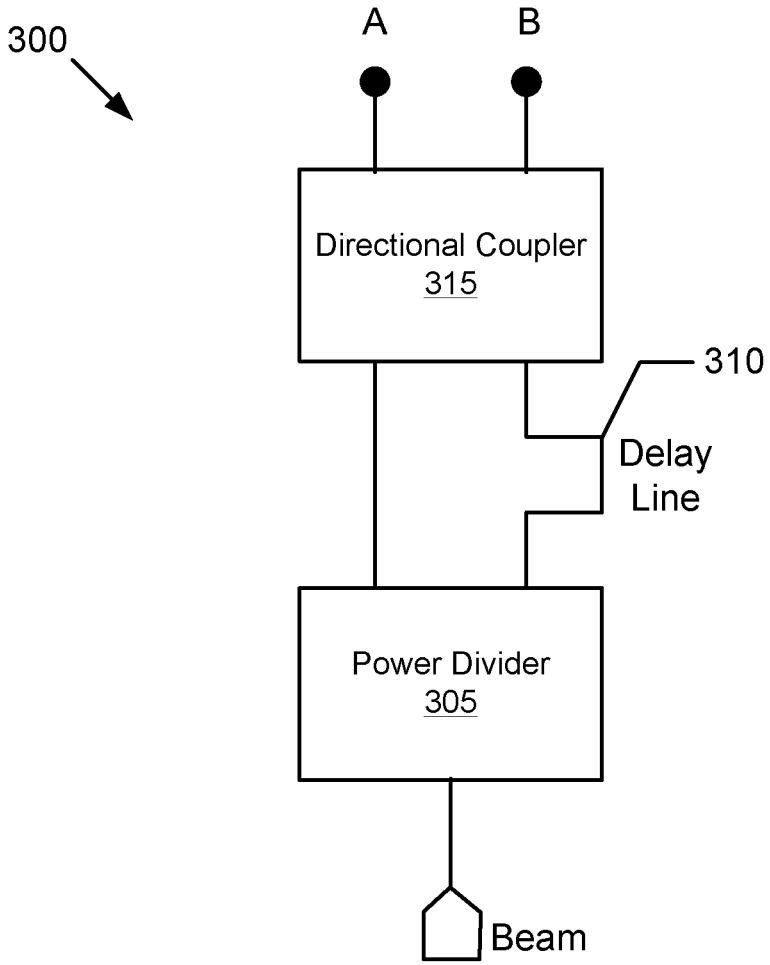
FIG. 3 is a block diagram of a frequency dependent power divider circuit according to some embodiments of the inventive concept.
FIG. 4 is a table that illustrates operations of the frequency dependent power divider circuit of FIG. 3 according to some embodiments of the inventive concept.

FIG. 3 is a block diagram of a frequency dependent power divider circuit 300 according to some embodiments of the inventive concept. The frequency dependent power divider circuit 300 comprises a power divider 305 having a first output that is coupled to a first input of a directional coupler 315. A second output of the power divider 305 is coupled to a second input of the directional coupler 315 via a delay line 310. The power divider 305 splits the signal from the beam into two signals. The power divider 305 may divide the power approximately equally between its two output terminals. The delay line 310 imposes a phase delay to the signal received from the power divider 305 and provides this phase delayed signal as an input signal to the directional coupler 315. The delay line 310 may have a fixed length, which results in the phase delay applied to the signal output from the power divider 305 to vary with frequency. For a given time delay, higher frequency signals experience more phase delay than low frequency signals. The directional coupler 315 receives equal amplitude signals as input signals where the signal received from the delay line 310 experiences increasing phase delay with increasing frequency. The directional coupler 315 outputs equal phase, variable amplitude signals where the amount of amplitude difference depends on the phase delay between the inputs, where the phase delay increases with increasing frequency. In accordance with some embodiments of the inventive concept, the directional coupler 315 may be 90° hybrid branch-line coupler with an operable bandwidth of approximately 690 MHz-2700 MHz. The power divider 305 may be, for example, a 3 dB multi-section Wilkinson power divider.

FIG. 4 is a table that illustrates operations of the frequency dependent power divider circuit 300 of FIG. 3 according to some embodiments of the inventive concept. When the delay line 310 provides a phase delay φ of 0°, then the signal power at output terminals A and B of the directional coupler 315 is split approximately evenly with each terminal receiving ½ power. When the delay line 310 provides a phase delay φ of 90°, then the signal power is directed approximately in its entirety to terminal A with terminal B receiving approximately zero signal power. When the delay line 310 provides a phase delay φ of −90°, then the signal power is directed approximately in its entirety to terminal B with terminal A receiving approximately zero signal power.

As described above, some governmental jurisdictions place limits on antenna gain at one or more frequencies. The frequency dependent power divider circuit 300 of FIG. 3 may be configured to divert power towards one of the output terminals A or B at a frequency at which transmitted signal power is to be reduced and may be configured to divert power towards another one of the output terminals A or B at a frequency at which transmitted signal power is to be maintained. Embodiments of the inventive concept may be illustrated by way of example. A communication system may operate by transmitting in frequency bands 1710 MHz-1880 MHz, 1910 MHz-2170 MHz, and 2496 MHz-2690 MHz. A governmental regulation may limit the antenna gain at 2560 MHz to a threshold of no more than 17.0 dB. Thus, it may be desirable to reduce the gain at 2560 MHz without adversely impacting the gain in the other frequency bands of 1710 MHz-1880 MHz and 1910 MHz-2170 MHz. Using a frequency of 1940 MHz, which is at the center of the bands 1710 MHz-1880 MHz and 1910 MHz-2170 MHz, the frequency dependent power divider circuit 300 can be tuned so that the delay line 310 generates a phase delay φ of approximately −90° at 1940 MHz, this results in approximately all of the signal power being diverted to terminal B. When delay line 310 is configured to generate a phase delay φ of approximately −90° at 1940 MHz, then the following phase delays may be generated at frequencies 1750 MHz, 2170 MHz, and 2560 MHz:

φ=−116° at 1750 MHz

φ=−57° at 2170 MHz

φ=−4° at 2560 MHz

Thus, at 2560 MHz, the frequency dependent power divider circuit 300 divides the signal power approximately equally between terminals A and B. The frequency dependent power divider circuit 300 can be used in an antenna system to adjust the signal power directed to a radiating element to ensure the antenna gain does not exceed a defined threshold as will be described below with reference to FIG. 5.

Figure 5:
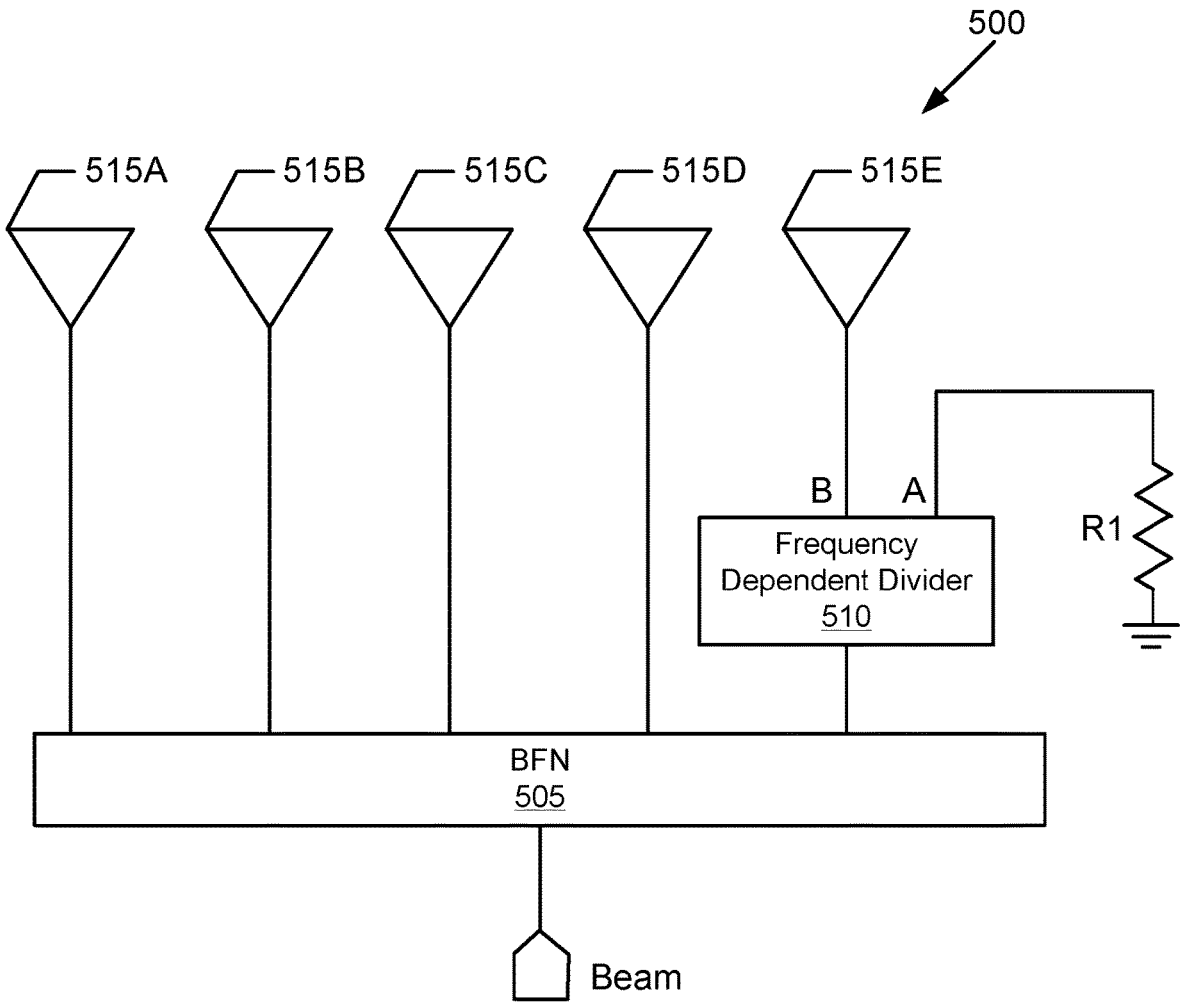
FIG. 5 is a schematic of an antenna system including a frequency dependent power divider circuit according to some embodiments of the inventive concept.

FIG. 5 is a schematic of an antenna system 500 including a frequency dependent power divider circuit 510 according to some embodiments of the inventive concept. The antenna system 500 comprises a beam forming network (BFN) that receives a beam and distributes the signal to five different radiating elements 515A, 515B, 515C, 515D, and 515E. Each of these radiating elements 515A, 515B, 515C, 515D, and 515E may represent an entire antenna, a linear array of radiating elements that comprises part of an antenna, and/or a single radiating element that is part of a larger array of radiating elements in accordance with various embodiments of the inventive concept. As shown in FIG. 5, a frequency dependent power divider circuit 510 is used as an interface to the radiating element 515E. Specifically, the frequency dependent power divider circuit 510 receives an output signal from the BFN 505 and diverts a portion of the signal power through terminal B to the radiating element 515E and another portion of the signal power through terminal A, which is coupled to an impedance element, such as resistor R1 shown in FIG. 5. The frequency dependent power divider circuit 510 may be implemented using the frequency dependent power divider circuit 300 of FIG. 3. Applying the example described above to the example antenna system 500 of FIG. 5, the frequency dependent power divider circuit 510 diverts approximately half of the signal power away from the radiating element 515E to ground through resistor R1 at a signal frequency of 2560 MHz. This may reduce the gain of the antenna system 500 by reducing the energy directed to the radiating element 515E. The reduced energy results in an increase in the taper of the aperture of the signal driving radiating element 515E. The energy diverted to the resistor R1 represents an increase in the insertion loss of the antenna.

In the present example, it is generally desired to avoid decreasing the gain in the 1710 MHz-1880 MHz and 1910 MHz-2170 MHz frequency bands. The phase delay φ at 1750 MHz is approximately −116° and the phase delay φ at 2170 MHz is approximately −57°. As shown in FIG. 4, when the phase delay φ is −90°, then virtually all of the signal power is directed to output terminal B of the frequency dependent power divider circuit 510. Because the phase delay φ in the desired frequency ranges is not precisely −90°, the frequency dependent power divider circuit 510 will divert some of the signal power to the resistor R1 through terminal A. While it will not be a full half-power reduction in signal power, the gain of the antenna system 500 will nevertheless be marginally reduced due to the reduction in signal power directed to the radiating element 515E. To reduce the impact of power attenuation in the desired frequency bands, the frequency dependent power divider circuits 300 and 510 may incorporate a stub circuit as described below with respect to FIG. 6.

Figure 6:
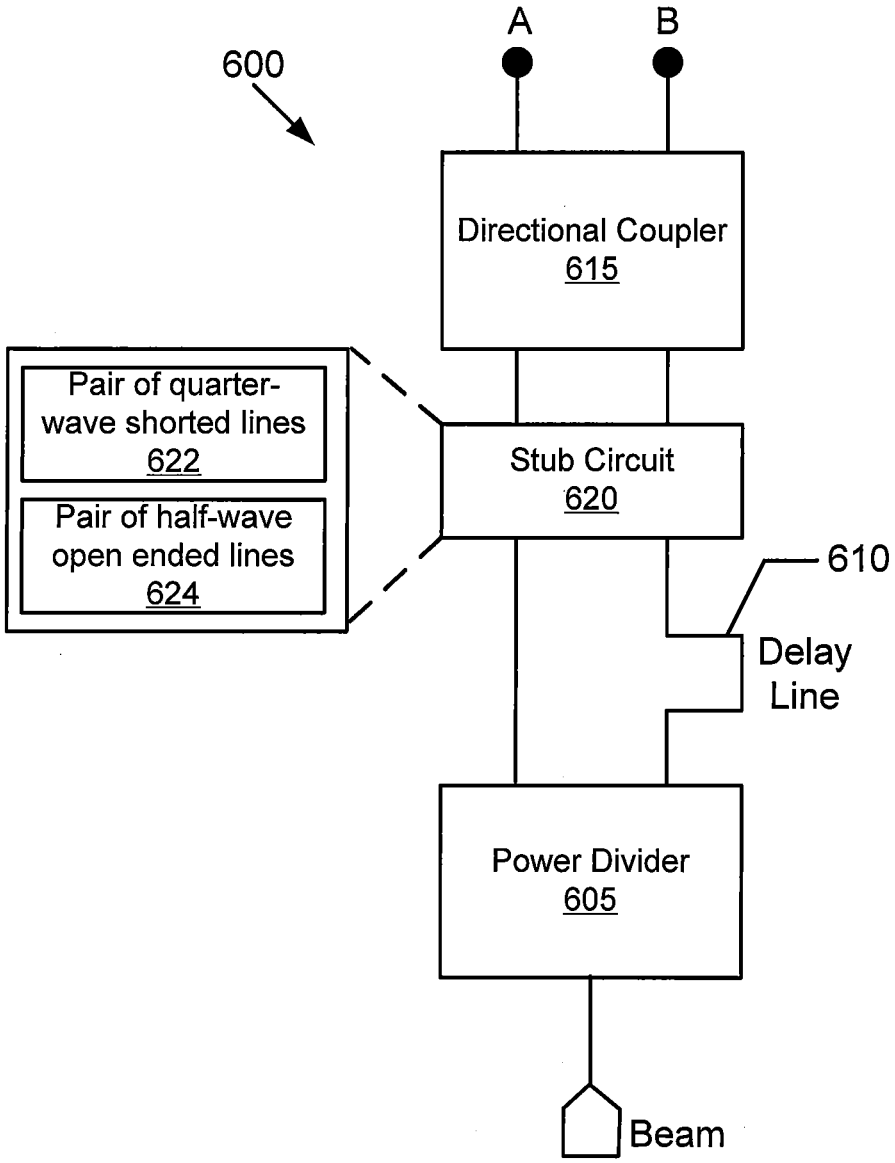
FIG. 6 is a block diagram of a frequency dependent power divider circuit including a stub circuit according to some embodiments of the inventive concept.

FIG. 6 is a block diagram of a frequency dependent power divider circuit 600 including a stub circuit 620 according to some embodiments of the inventive concept. The frequency dependent power divider circuit 600 comprises a power divider 605, a delay line 610, and a directional coupler 615 that are configured as shown and may be implemented as described above with respect to corresponding elements in FIG. 3. The frequency dependent power divider circuit 600 differs from the frequency dependent power divider circuit 300 with the addition of a stub circuit 620 between the delay line 610 and the directional coupler 615 and the power divider 605 and the directional coupler 615. The stub circuit 620 may include one or more stubs or resonant stubs connected to the transmission lines input to the directional coupler 615. A stub or resonant stub is a length of transmission line or waveguide that is connected at one end only. The free end of the stub is either left as an open-circuit or is short circuited to a reference terminal or plane. The input impedance of the stub is reactive—either capacitive or inductive—depending on the electrical length of the stub and whether it is configured as an open or short circuit. A stub may function as a capacitor, inductor, and/or a resonant circuit at radio frequencies. The stub circuit may provide, for example, phase compensation stubs to drive the phase delay φ closer −90° to allow more of the energy to be diverted to terminal B of the directional coupler 615. In some embodiments, two quarter-wave shorted lines 622 may be used as the compensation stubs to compensate 90° and/or two half-wave open ended lines 624 may be used as the compensation stubs to compensate 180°. Thus, in some embodiments, the frequency dependent power divider circuit 510 of FIG. 5 may be implemented using the frequency dependent power divider circuit 600 of FIG. 6 to increase the power diverted to the radiating element 515E of FIG. 5 through terminal B of the directional coupler 615 to reduce the amount of gain reduction for the antenna system 500 in the 1710 MHz-1880 MHz and 1910 MHz-2170 MHz frequency bands.

Figure 7A:
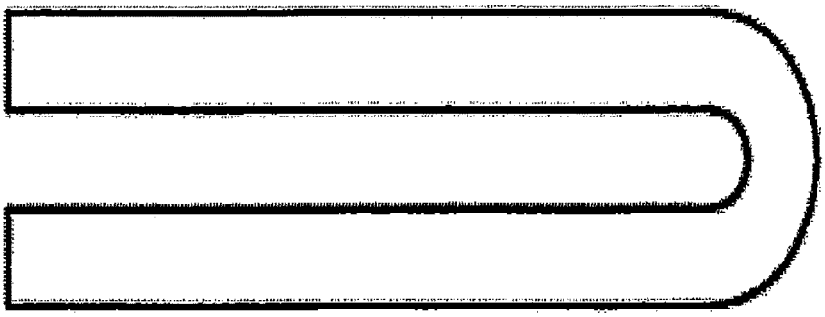
FIGS. 7A-7C are diagrams that illustrate configurations of a delay line according to some embodiments of the inventive concept.

The delay line 310 of FIG. 3 and the delay line of 610 of FIG. 6 may be implemented in different ways according to various embodiments of the inventive concept. FIG. 7A illustrates an example of a delay line in which the phase delay is directly proportional to frequency and can be used to implement the delay line 310 of FIG. 3 and the delay line 610 of FIG. 6 according to some embodiments of the inventive concept. The delay line of FIG. 7A may comprise a 50 Ohm microstrip line with a length d, where the phase delay $\varphi=[2\pi d(\varepsilon_{eff}^{1/2})]/\lambda_0$, where $\varepsilon_{eff}$ is the effective dielectric constant of the substrate material and $\lambda_0$ is the wavelength in free space.

Figure 7B:
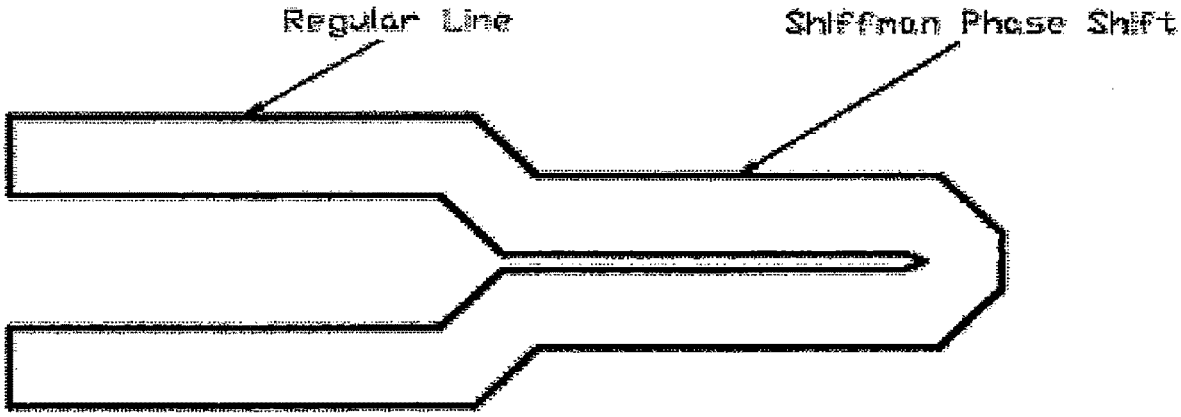

FIG. 7B illustrates an example of a delay line comprising a regular transmission line combined with a Shiffman phase shifter. A Shiffman phase shifter may provide substantially constant phase over the frequency band. As a result, the phase for the delay line of FIG. 7B may change more slowly with frequency as compared to the embodiment of FIG. 7A.

Figure 7C:
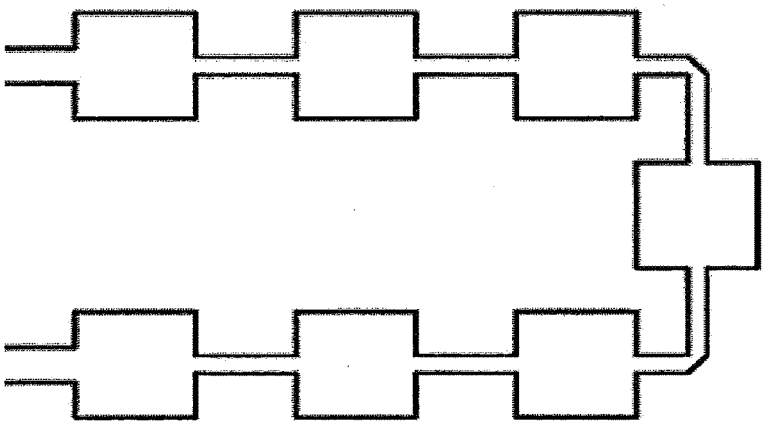

FIG. 7C illustrates an example of a loaded delay line comprising narrow sections (series inductances) in combination with wide sections (parallel capacitances), which may provide about 15%-30% faster phase change as compared to the embodiment of FIG. 7A.

The selection of a particular type of delay line to implement the delay line 310 of FIG. 3 and the delay line 610 of FIG. 6 may be based on a desired relationship between signal amplitude and frequency and a desired beam position, width, and/or sidelobes.

Some embodiments of the inventive concept may, therefore, provide an antenna system with a frequency dependent power divider circuit that may be used to reduce the amount of power directed to one or more radiating elements in the antenna system. When it is desired to reduce the antenna gain at a particular frequency, the frequency dependent power divider circuit may be tuned so as to divert a desired amount of power away from, for example, one of the antenna's radiating elements. In the example described above, half of the signal power is diverted away from a radiating element at the target frequency. The delay line used in the frequency dependent power divider circuit may be tuned such that more or less signal power is diverted away from a radiating element at the target frequency. In some embodiments, virtually all of the power may be diverted away from the radiating element effectively eliminating that element from the antenna at the target frequency. Moreover, in some embodiments, the frequency dependent power divider circuit may be duplicated so as to be inserted in the paths of multiple radiating elements so that the signal power is reduced for multiple ones of the radiating elements thereby decreasing the directivity of the antenna system at the target frequency to an even greater degree. For example, frequency dependent power divider circuits may be inserted in the paths of respective radiating elements at either end of an array of radiating elements so as to reduce the signal power directed to radiating elements at the array ends. In some embodiments, the reduction in signal power may be greater the closer a radiating element is to the end of an array. To reduce the impact of the signal power reduction at the target frequency on other frequency bands, a stub circuit may configured for use in the frequency dependent power divider circuit to reduce the amount the signal power diversion away from a radiating element for a particular frequency or band of frequencies.

FURTHER DEFINITIONS AND EMBODIMENTS

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Like reference numbers signify like elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

The terminology used herein to describe embodiments of the invention is not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The corresponding structures, materials, acts, and equivalents of any means or step plus function elements in the claims below are intended to include any disclosed structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

What is claimed is:

1. An antenna, comprising:

a frequency dependent divider circuit configured to receive an input signal and generate an output signal, the output signal having a power level based on a frequency of the input signal; and a radiating element that is responsive to the output signal;

wherein the frequency dependent divider circuit comprises:

a power divider that is configured to generate a first divided output signal and a second divided output signal responsive to the input signal;

a delay line that is configured to generate a phase delayed output signal responsive to the second divided output signal, the phase delayed output signal having a phase delay based on a frequency of the second divided output signal;

a stub circuit configured to generate first and second coupler input signals responsive to the phase delayed output signal and the first divided output signal, the stub circuit being further configured to generate the first coupler input signal by modifying the phase delay of the phase delayed output signal such that the modified phase delay is closer to a target phase delay when the frequency of the input signal is in a first frequency band and when the frequency of the input signal is in a second frequency band; and a directional coupler that is configured to generate the output signal responsive to the first and second coupler input signals.

2. The antenna of claim 1, wherein the delay line comprises:

a transmission line configured to generate the phase delay directly proportional to the frequency of the second divided output signal.

3. The antenna of claim 1, wherein the delay line comprises:

a transmission line coupled to a Shiffman phase shifter;

wherein the Shiffman phase shifter is configured to substantially maintain the phase delay independent of frequency.

4. The antenna of claim 1, wherein the delay line comprises:

an inductive portion and a capacitive portion.

5. The antenna of claim 1, wherein the stub circuit comprises a pair of quarter-wave shorted lines.

6. The antenna of claim 1, wherein the stub circuit comprises a pair of half-wave open ended lines.

7. The antenna of claim 1, wherein an input impedance of the stub circuit is capacitive.

8. The antenna of claim 1, wherein an input impedance of the stub circuit is inductive.

9. The antenna of claim 1, wherein the directional coupler is a 90° hybrid branch-line coupler having an operational bandwidth of approximately 690 MHz-2700 MHz.

10. The antenna of claim 1, wherein the power divider is a 3 dB multi-section Wilkinson power divider.

11. The antenna of claim 1, wherein the radiating element comprises a linear array of radiating elements.

12. The antenna of claim 11, wherein the output signal comprises a plurality of output signals associated with the linear array of radiating elements, respectively; and wherein the frequency dependent divider circuit is further configured to generate the plurality of output signals so as to have increasingly tapered power levels at each end of the linear array.

13. The antenna of claim 1, wherein the radiating element comprises one of a plurality of radiating elements.

14. The antenna of claim 1, wherein the frequency dependent divider circuit is further configured to adjust a taper of a radiation pattern aperture of the output signal based on the frequency of the input signal.

15. The antenna of claim 1, wherein the frequency dependent divider circuit is further configured to adjust an insertion loss of the antenna based on the frequency of the input signal.

16. The antenna of claim 1, wherein the first frequency band is 1710 MHz-1880 MHz, and the second frequency band is 1910 MHz-2170 MHz.

* * * * *